US005337717A

United States Patent [19]

Scheel et al.

[11] Patent Number: 5,337,717

[45] Date of Patent: Aug. 16, 1994

[54] TIMING CONTROL FOR AN ENGINE HAVING A CAPACITOR DISCHARGE IGNITION SYSTEM

[75] Inventors: Horst Scheel, Peoria; Thomas T. Stevenson, Dunlap, both of Ill.

[73] Assignee: Caterpillar Inc., Peoria, Ill.

[21] Appl. No.: 956,769

[22] PCT Filed: May 31, 1991

[86] PCT No.: PCT/US91/03774

§ 371 Date: May 31, 1991

§ 102(e) Date: May 31, 1991

[87] PCT Pub. No.: WO90/06517

PCT Pub. Date: Jun. 14, 1990

[51] Int. Cl.[5] ..... F02P 5/15

[52] U.S. Cl. ..... 123/426; 123/643; 123/644

[58] Field of Search ..... 123/426, 609, 643, 644

[56] References Cited

U.S. PATENT DOCUMENTS

| | | | |
|---|---|---|---|
| 3,844,266 | 10/1974 | Peterson | 123/604 |
| 4,649,888 | 3/1987 | Kawai et al. | 123/609 |
| 4,913,123 | 4/1990 | DeBiasi et al. | 123/426 X |
| 5,060,623 | 10/1991 | McCoy | 123/605 |
| 5,156,127 | 10/1992 | Ghaen | 123/426 |

FOREIGN PATENT DOCUMENTS

| | | |
|---|---|---|
| 2493414 | 5/1982 | France . |
| WO88/01690 | 3/1988 | PCT Int'l Appl. . |
| WO90/06517 | 6/1990 | PCT Int'l Appl. . |

*Primary Examiner*—Tony M. Argenbright
*Attorney, Agent, or Firm*—R. Carl Wilbur

[57] ABSTRACT

An apparatus (8) is provided for controlling ignition in an engine having a ignition system (10), an engine cylinder sensor (48), and a piston disposed in the cylinder and being movable to a top dead center (TDC) position. The cylinder sensor (48) produces a first signal representing the position of the piston within the cylinder and having a frequency responsive to engine speed. The ignition system (10) includes a transformer (24) having a primary coil (26) which is energized in response to a cylinder select signal to produce sparking across an associated spark plug gap (22). A first circuit (98) is provided for sensing a delay between production of the cylinder select signal and the time at which current through a respective primary coil exceeds a preselected current level, and responsively producing a timing error signal. The cylinder selector (36) processes the timing error signal to produce a timing offset signal The cylinder selector then delivers a cylinder select signal as a function of the timing offset and a desired cylinder firing time. In this manner, the apparatus (8) compensates for the timing error introduced by the time required for transformer energization.

19 Claims, 7 Drawing Sheets

Fig_1_

Fig_3_
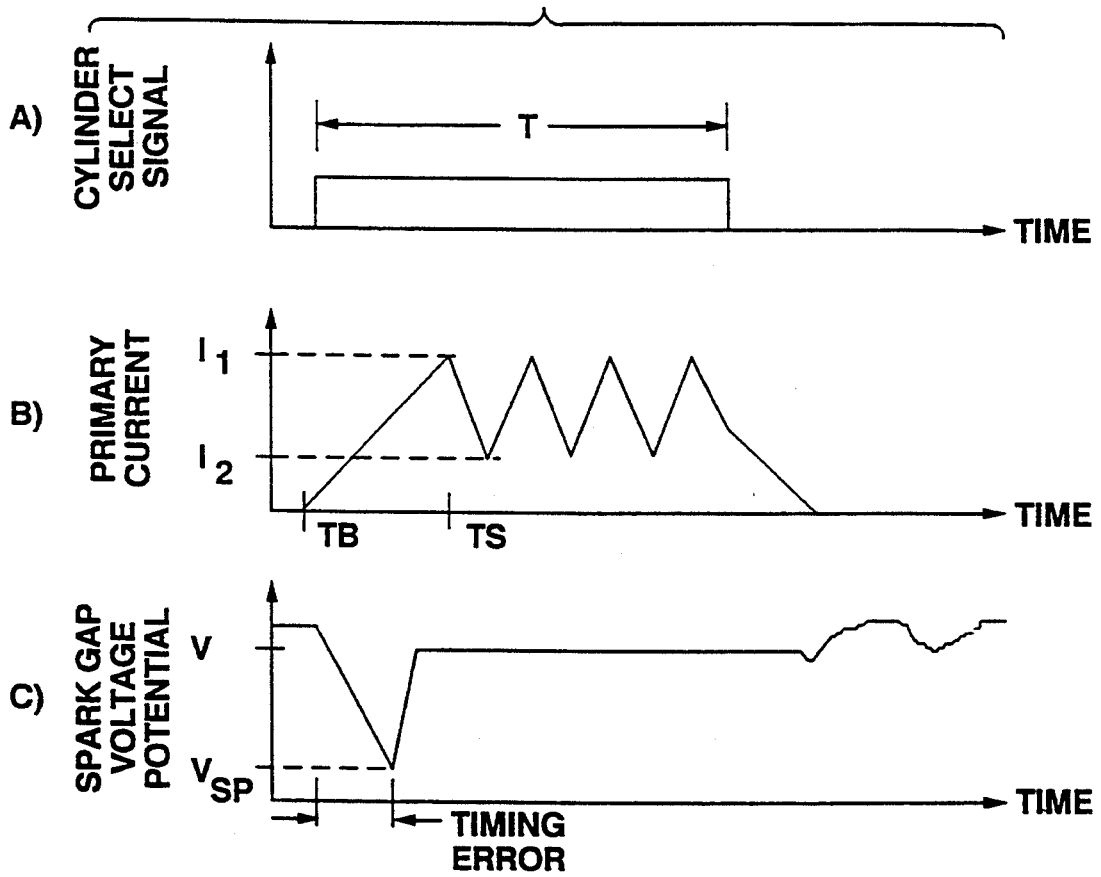
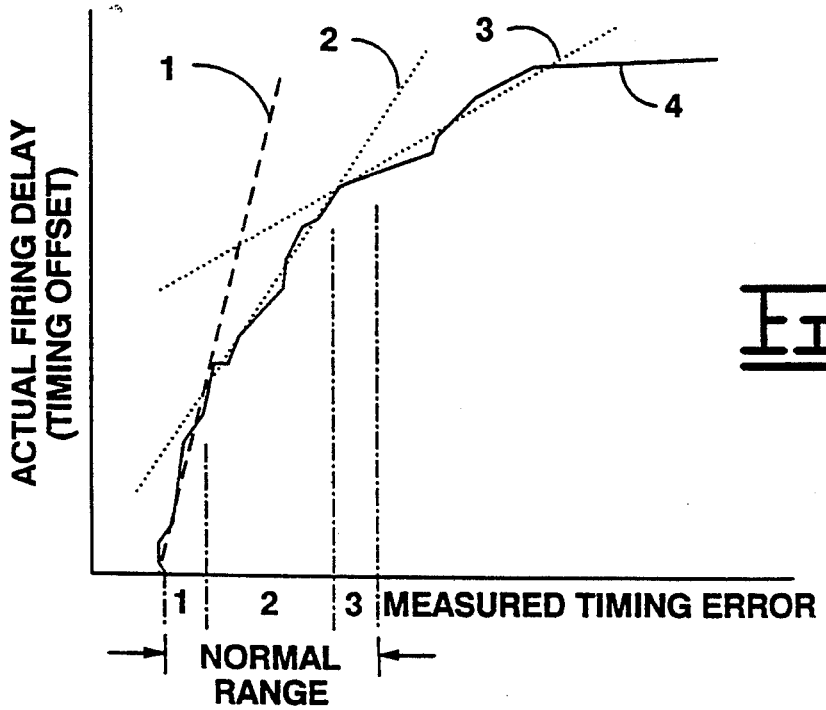
Fig_6_

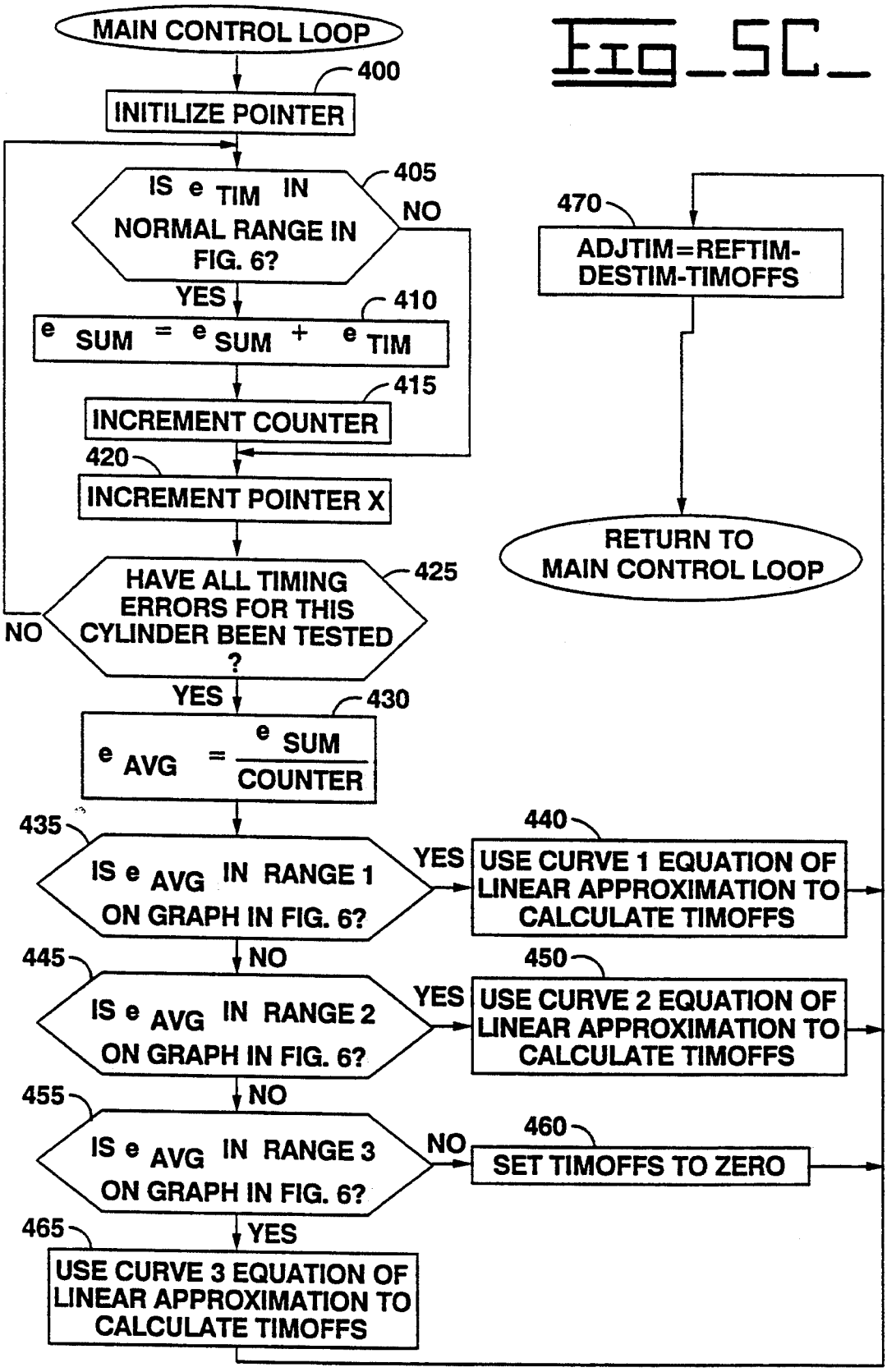
Fig_5C_
MAIN CONTROL LOOP
400
INITILIZE POINTER
405
IS e TIM IN NORMAL RANGE IN FIG. 6?
NO
YES
410
e SUM = e SUM + e TIM
415
INCREMENT COUNTER
420
INCREMENT POINTER X
425
HAVE ALL TIMING ERRORS FOR THIS CYLINDER BEEN TESTED ?
NO
YES
430
e AVG = e SUM / COUNTER
435
IS e AVG IN RANGE 1 ON GRAPH IN FIG. 6?
YES
440
USE CURVE 1 EQUATION OF LINEAR APPROXIMATION TO CALCULATE TIMOFFS
NO
445
IS e AVG IN RANGE 2 ON GRAPH IN FIG. 6?
YES
450
USE CURVE 2 EQUATION OF LINEAR APPROXIMATION TO CALCULATE TIMOFFS
NO
455
IS e AVG IN RANGE 3 ON GRAPH IN FIG. 6?
NO
460
SET TIMOFFS TO ZERO
YES
465
USE CURVE 3 EQUATION OF LINEAR APPROXIMATION TO CALCULATE TIMOFFS
470
ADJTIM=REFTIM-DESTIM-TIMOFFS
RETURN TO MAIN CONTROL LOOP

TIMING CONTROL FOR AN ENGINE HAVING A CAPACITOR DISCHARGE IGNITION SYSTEM

TECHNICAL FIELD

This invention relates generally to a timing control for an internal combustion engine having a capacitor discharge ignition system and, more particularly, to a timing control which adjusts ignition timing to compensate for a delay between transformer energization and actual ignition.

BACKGROUND ART

In the field of internal combustion engine controls it is a well recognized principle that accurate ignition timing is necessary to maintain stable and efficient engine operation. In spark ignited engines, ignition occurs upon firing of the spark plug in the cylinder. The "timing" of such an engine is defined as the time at which an ignition signal is delivered to the spark plug relative to the time at which the piston reaches the end of its stroke in the compression cycle. This position is commonly referred to as "top dead center" (TDC), and timing is measured in crankshaft degrees with respect to TDC, for example 25 degrees before TDC (BTDC.)

In the past, ignition timing was controlled by magnetos and as such the timing angle could only be mechanically adjusted during servicing. Recently, electronics and in particular microprocessors have been adapted to control ignition timing. Electronic ignition controls have the advantage of being able to retard (closer to TDC) and advance (further from TDC) engine timing in response to sensed parameters, such as engine speed, engine load, air/fuel ratio and altitude. Generally, the electronic controls set a timing angle which is used for all engine cylinders; however, more sophisticated controls develop separate timing angles for each cylinder.

Capacitor Discharge Ignition Systems ("CDI's") typically include a charge storage mechanism, such as a capacitor, and a step-up transformer with a secondary coil connected,to a spark ignition device, such as a spark plug. The ignition timing controller is adapted to discharge the capacitor through the transformer primary coil at the desired timing angle. Discharge of the capacitor through the transformer primary coil induces a high voltage signal in the transformer secondary coil, which, if sufficiently high, causes a spark to arc across the spark plug gap. The voltage applied across a spark plug must be greater than or equal to a predetermined characteristic "spark ionization potential" (voltage) $V_{SP}$ in order to initiate the spark. Such ionization potentials are typically on the order of 10 Kv or more. The ionization potential $V_{SP}$ is dependent on factors such as spark plug gap, cylinder pressure, engine load, and air/fuel ratio.

The time required for the transformer to energize to a level sufficient to cause sparking introduces a delay between the production of the ignition signal and actual ignition in the cylinder. This timing "error" can degrade overall engine operation and efficiency. To date, timing controls for engines having capacitor discharge ignitions have failed to address this problem. Partial compensation for the timing error could be achieved by introducing a predetermined timing offset. However, the delay between transformer energization and the spark plug firing is dependent on dynamic engine characteristics and performance factors, such as air/fuel ratio, cylinder pressure, and spark plug gap. As such a predetermined timing offset would only achieve marginal improvements at best.

The subject invention is directed toward overcoming the above problems by providing timing control which adjusts ignition timing to compensate for a delay between transformer energization and actual ignition.

DISCLOSURE OF THE INVENTION

An apparatus is provided for controlling ignition in an engine having an ignition system, a cylinder sensor, and a piston disposed in the cylinder and being movable to a top dead center (TDC) position. The cylinder sensor produces a first signal representing the position of the piston within the cylinder and having a frequency responsive to engine speed. The ignition system includes a transformer having a primary coil which is energized in response to a cylinder select signal to produce sparking across an associated spark plug gap. A first circuit is provided for sensing a delay between production of the cylinder select signal and ignition in the cylinder and responsively producing a timing error signal. A cylinder selector receives the first signal and the timing error signal and processes the first signal to producing a reference timing signal which represents the time between first and second reference points of the first signal. The second reference point indicates the time at which the piston is at the TDC position. The cylinder selector further produces a desired timing signal representing the time between a third reference point of the first signal and the second reference point. The third reference point occurs prior to the second reference point and indicates the time at which ignition desirably occurs. The cylinder selector further processes the timing error signal to produce a timing offset signal and produces a control delay signal responsive to the reference timing signal less the timing offset and desired timing signals. The selector means delivers the cylinder select signal at a time, as represented by the control delay signal, subsequent to the first point on the first signal. In this manner, the apparatus compensates for any timing error introduced by the time required for transformer energization.

BRIEF DESCRIPTION OF THE DRAWINGS

FIGS. 3A–C are graphic illustrations of certain waveforms associated with the circuits of FIGS. 1 and 4;

FIGS. 5B and 5C are software flowcharts illustrating alternate embodiments of a Timing Error Subroutine which can be used in programming a microprocessor to adjust timing in response to a sensed timing error; and FIG. 6 is a graph of actual firing time versus measured timing error.

BEST MODE FOR CARRYING OUT THE INVENTION

Figure 1:
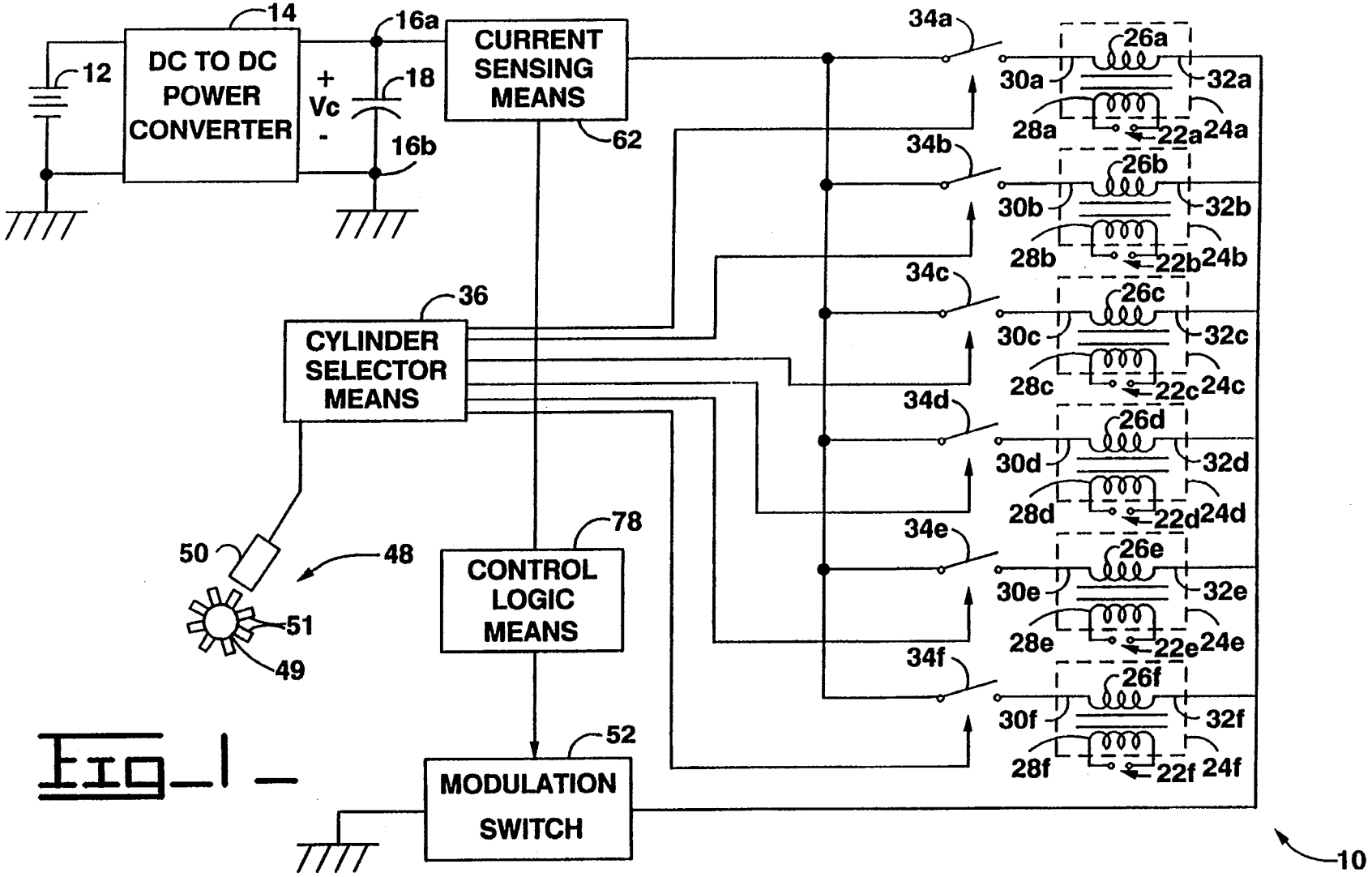
FIG. 1 is an illustrative block diagram of a capacitive discharge ignition system which can be adapted for use with the immediate invention.

Referring now to the drawings, the immediate timing controller 8 will be described in connection with a capacitor discharge ignition system 10. The timing controller 8 can be adapted for use with numerous capacitor discharge ignition systems. However, the timing controller 8 will be described in connection with an ignition system as disclosed in U.S. patent application Ser. No. 07/630,578, filed on Dec. 20, 1990, now U.S. Pat. No. 5,060,623, entitled "Spark Duration Control For A Capacitor Discharge Ignition System," assigned to the assignee herein, and the disclosure of which is specifically incorporated by reference.

Figure 4:
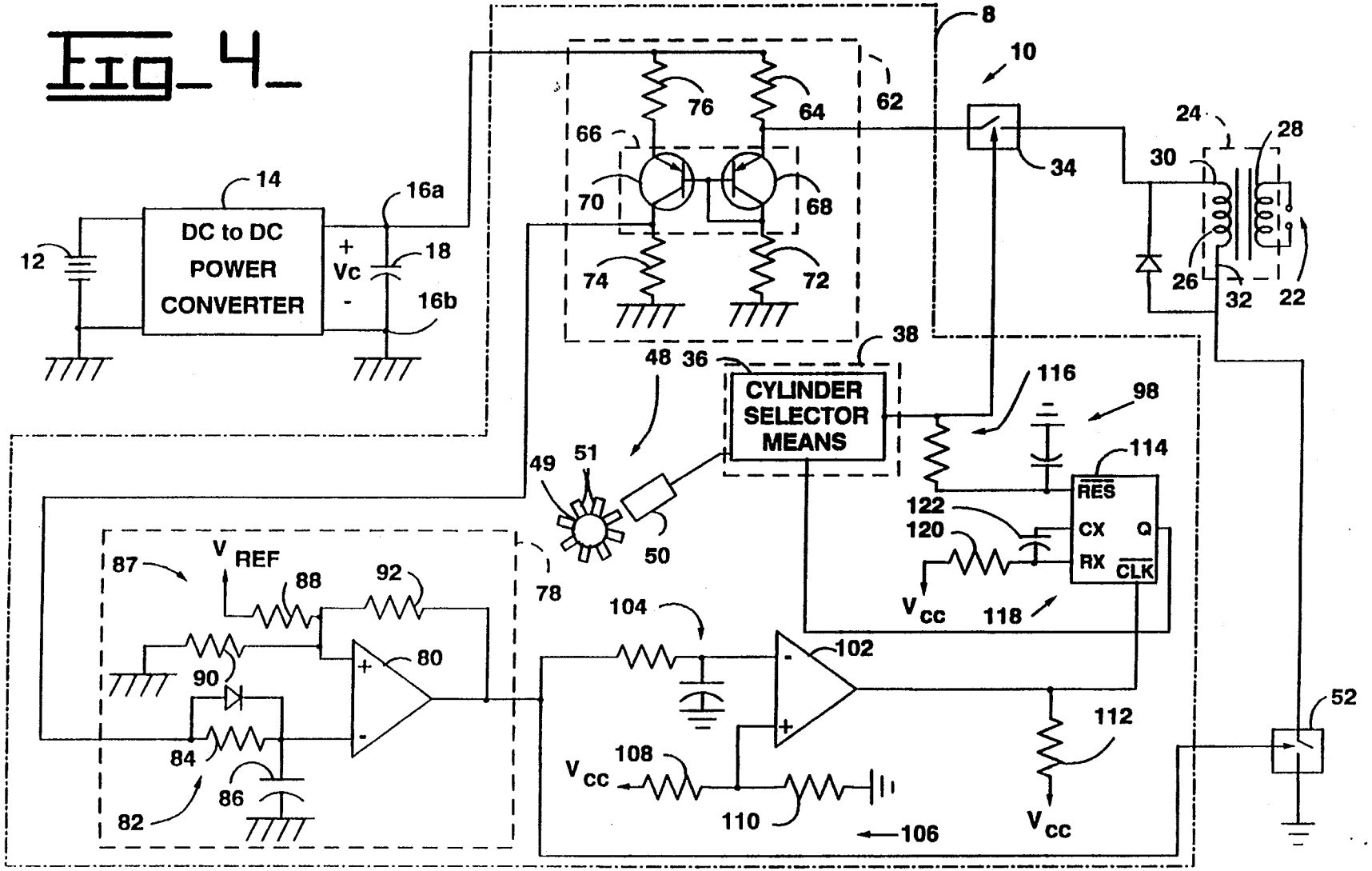
FIG. 4 is circuit diagram of an embodiment of the ignition system of FIG. 1 which incorporates the immediate invention.

The ignition system 10 is shown generally in FIG. 1. FIG. 4 illustrates the ignition system 10 incorporating the immediate timing controller 8. The timing controller 8 and the ignition system 10 will work with an internal combustion engine having any number of cylinders provided electrical components acre sized properly. Currently, the timing controller 8 and the ignition systems 10 are being developed for use with a series 3500 SI engine as manufactured by Caterpillar, Inc. of Peoria, Ill. The series 3500 SI engine has 16 cylinders; however, for simplification FIG. 1 is described in connection with a six cylinder engine, and FIG. 1 and 4 is illustrated in connection with a single engine cylinder.

The ignition system 10 includes a power source 12, such as a battery, connected to a DC-to-DC power converter 14. The power converter 14 is a continuously operating, high speed charging circuit and it is electrically connected to first and second terminals 16*a*, 16*b* of an ignition capacitor 18. The power converter 14 is provided for rapidly charging the ignition capacitor 18 and continuously supplying power to the capacitor 18 to maintain the capacitor first terminal 16*a* at a predetermined electrical potential above the capacitor second terminal 16*b*. More particularly, the capacitor second terminal 16*b* is connected to system ground and the first terminal 16*a* is maintained a preselected potential $V_c$ above system ground. In the preferred embodiment, the preselected potential $V_c$ is on the order of 200 volts. Power converters of this type are common in the art and, therefore, it will not be explained in greater detail. One such circuit is generally disclosed in U.S. Pat. No. 3,677,253 which issued on Jul. 18, 1972 to Oishi et al.

Each engine cylinder (not shown) includes a spark plug (not shown) having an associated spark gap 22*a–f*. Step-up transformers 24*a–f* are provided for each cylinder to control operation of an associated spark plug. Each transformer 24*a–f* has a primary coil 26*a–f* and a secondary coil 28*a–f*. The transformer primary coils 26*a–f* each include first and second terminals 30*a–f*, 32*a–f*. The transformer secondary coils 28*a–f* are electrically connected in series with spark gaps 22*a–f* in associated engine cylinders.

Selector switches 34*a–f* are connected between the ignition capacitor first terminal 16*a* and an associated one of the primary coil first terminals 30*a–f*. Numerous electrical switching devices, such as transistors, can be adapted to perform the functions of the selector switches 34*a–f* and, therefore, the selector switches 34*a–f* will not be described in great detail. The selector switches 34*a–f* are normally biased open and are adapted to close in response to receiving a cylinder select signals (see FIG. 3A) from a cylinder selector means 36 (i.e. timing controller.) When a selector switch 34 is biased closed, the ignition capacitor first terminal 16*a* and the primary coil first terminal 30*a–f*, of an associated transformer 24*a–f*, are electrically connected, thereby establishing a current path through the primary coil 26*a–f*.

The cylinder selector means 36 is provided for operating the selector switches 34*a–f* in a timed sequence corresponding to a desired ignition sequence for the engine. The cylinder selector means 36 may be implemented with any suitable hardware including analog or digital circuits; however, the cylinder selector means 36 is preferably embodied in a microcontroller (MCU) 38 operating under software control. A number of commercially available devices are adequate for performing the control functions of the MCU 38, such as the MC6800 series component manufactured by Motorola Semiconductor Products, Inc., Austin, Tex.

Figure 2:
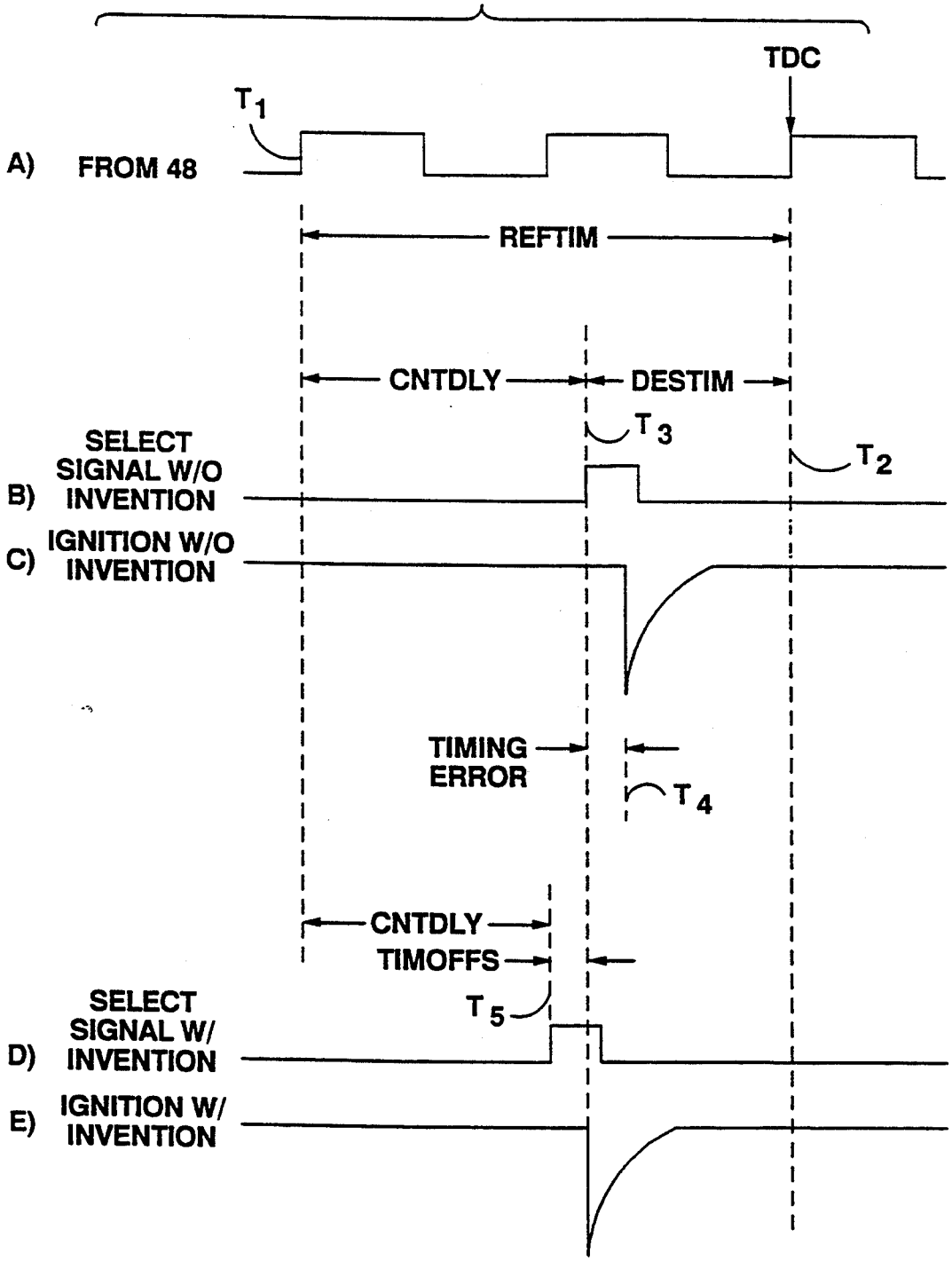
FIGS. 2A–E contain waveform diagrams illustrating timing parameters involved in the present invention.

The cylinder selector means 36 receives a first signal corresponding to engine speed and cylinder position from a sensor means 48. Preferably this function is performed using a single sensor such as that disclosed in U.S. Pat. No. 4,972,323 which issued on Nov. 20, 1990 to Luebbering et al., is assigned to the assignee herein, and the disclosure of which is specifically incorporated herein. However, it is foreseeable to use separate sensors for engine speed and cylinder position, respectively. The cylinder sensor means 48 is in the form of a toothed timing wheel or gear 49 and a magnetic pickup unit (MPU) 50 such as a Hall effect device. The timing wheel 49 includes a series of circumferentially spaced teeth 51. In addition, the wheel is mounted on a shaft (not shown) which is in turn coupled to a crankshaft or camshaft of the engine. The wheel 49 thus rotates as the engine is running, causing the teeth to pass beneath the MPU 50. In response to the passage of the teeth, the MPU 50 develops the first signal in the form of a pulse train, as illustrated in the waveform of FIG. 2A. The positions of the pistons in the engine cylinders are referenced to particular pulses on the first signal and the frequency of the first signal is responsive to engine speed.

A variety of other parameters can also be input to the cylinder selector means 36, such as engine load and air/fuel ratio. The cylinder selector means 36 processes these signals to produce cylinder select signals for controlling operation of the select switches 34*a–f*. The cylinder selector means 36 produces the cylinder select signals for a period of time T corresponding to the desired spark duration in an associated cylinder, (see FIG. 3A.) The selector switch 34*a–f* to which the selector signal is delivered remains closed while the selector signal is produced. The desired spark duration can be a constant period of time or it can be adjusted in response to sensed engine parameters, as would be apparent to one skilled in the art. In as much as timing controls of this type are well known in the art, no further description of the selector means 36 will be provided.

A modulation switch 52 is connected between the primary coil second terminals 32*a–f* and system ground for completing a current path for the primary coils 26*a–f*. When a cylinder select switch 34*a–f* and the modulation switch 52 are closed current begins to flow from the ignition capacitor 18 through the associated primary coil 26*a–f*. Numerous electrical switching devices, such as an n-channel MOSFET, can be adapted to perform the functions of the modulation switch 52 and, therefore, the modulation switch 52 will not be described in greater detail.

A current sensing means 62 senses the current flowing through any of the transformer primary coils 26*a–f* and responsively produces a primary current signal, (see FIG. 3B.) The current sensing means 62 includes a first current sensing resistor 64 connected between the selector switches 34*a–f* and the ignition capacitor first terminal 16*a*. A current mirror circuit 66 is connected to the first current sensing resistor 64 such that the current flowing through the resistor 64 is an input to the current mirror circuit 66. The current mirror circuit 66 delivers an output current signal which has a magnitude responsive to the magnitude of the current flowing through any of the primary coils 26*a–f*. Only one current mirror circuit 66 is required since only one of the cylinder select switches 34*a–f* is closed at any given instance in time.

The current mirror circuit 66 includes first and second pnp transistors 68, 70 wherein both transistors 68, 70 have bases connected to the other and to the collector of the first transistor 68. The collectors of the transistors 68, 70 are further connected to system ground through first and second resistors 72, 74, respectively. The emitter of the first pnp transistor 68 is connected to the ignition capacitor first terminal 16*a* through the first current sensing resistor 64. The emitter of the second pnp transistor 70 is connected to the ignition capacitor first terminal 16*a* through a second current sensing resistor 76. As would be apparent to one skilled in the art, selection of the ohmic values of the first and second current resistors 64, 76 controls the relationship between the input and output of the current mirror circuit 66.

The output of the current sensing means 62 is delivered to a control logic means 78 which produces control signals in response to the current mirror output signal. The control signals are applied to the modulation switch 52 to respectively open and close the modulation switch 52. The control logic means 78 operates the modulation switch 52 while a selector switch 34*a–f* is closed such that the current flowing in an associated primary coil initially rises to a first current threshold I1 which is normally sufficient to cause a spark to arc an associated spark gap 22*a–f*, (see FIG. 3B.) Thereafter, the spark is maintained by modulating the current in the primary coil 26*a–f* between the first current threshold I1 and a second current threshold I2 which is lower than the first current threshold I1. It should be noted that the primary current could be modulated at other levels to further minimize the current draw on the capacitor 18, as would be apparent to those skilled in the art.

The time required to reach the first current threshold provides an indication of the secondary load because it is a function of the voltage required to initiate a spark across the spark plug gap, (i.e. the characteristic ionization potential $V_{SP}$, see FIG. 3C.) The subject invention measures this time and processes it to determine a timing offset for adjusting ignition timing, as explained below.

The control logic means 78 includes a first comparator 80 having an inverting input terminal adapted to receive the current mirror output signal. The first comparator 80 is an open-collector type comparator having its inverting input terminal connected to the junction of the second pnp transistor 70 and the second resistor 74 through an R-C network 82. The current output from the current mirror circuit 66 establishes a voltage across the second resistor 74 which is applied to the first comparator inverting input terminal. As should be apparent, this voltage is proportional to the current flowing through the first current sensing resistor 64 and thus to the current in the primary coil 26*a–f*. The R-C network 82 includes a third resistor 84 serially connected between the junction of the second transistor's emitter and the first comparator inverting input terminal. The R-C network 82 further includes a first capacitor 86 connected between the junction of the third resistor 84 and the first comparator inverting input terminal and system ground.

The non-inverting input terminal of the comparator 80 is connected to a voltage divider network 87 for controlling the voltage level applied thereto. More particularly, the non-inverting input terminal is connected to a preselected reference potential $V_{REF}$ through a pull-up resistor 88 and to system ground through a fourth resistor 90. The non-inverting input terminal is further connected to the output terminal of the first comparator 80 through a seventh resistor 92. The output terminal of the first comparator 80 switches between logic "low" and logic "high" in response to the primary current signal rising above and falling below the the first and second current thresholds I1, I2, respectively.

When the first comparator output terminal is pulled "high," the voltage divider network 87 applies a third voltage potential to the first comparator non-inverting input terminal. The third voltage potential corresponds to a primary current having magnitude equal to the first current threshold I1. The first comparator output terminal is pulled "low" when the voltage applied to its inverting input terminal rises to the third voltage potential, thereby indicating that the primary current has reached the first current threshold I1. When the first comparator output terminal is pulled "low," the voltage divider network 87 applies a fourth voltage potential, which is lower than the third voltage potential, to the first comparator non-inverting input terminal. The fourth voltage potential corresponds to a primary current equal to the second current threshold I2. The output from the first comparator 80 is delivered to the modulation switch 52 to control operation of the switch. The modulation switch 52 is biased open and closed when the first comparator output is pulled "low" and "high," respectively.

Referring now to FIGS. 2A–E, operation of the present invention will be described in greater detail. FIGS. 2A–E are waveform diagrams illustrating timing parameters involved in the present invention. More specifically, FIG. 2A illustrates the first signal as produced by the sensor means 48. FIGS. 2B and 2C respectively illustrate production of a cylinder select signal and ignition in a respective cylinder of an engine without the present invention. FIGS. 2D and 2E respectively illustrate production of a select signal and ignition in a respective cylinder in an engine equipped with the present invention.

The selector means 36 stores a value REFTIM in memory which is a reference timing value representing the time between a first point $T_1$ of the first signal and a second point $T_2$ of the first signal which corresponds to the time at which the piston reaches TDC. In the preferred embodiment, the time period represented by REFTIM commences upon the rising edge of a particular pulse of the signal developed by the MPU 50 at the first point time $T_1$ and ends at the second point $T_2$. Also stored is a value or a series of values DESTIM representing the time between a third point $T_3$ corresponding to the desired ignition timing and the second point $T_2$. The DESTIM values are developed as a function of engine parameters such as engine speed, engine load and air/fuel ratio. A single DESTIM value can be used for all engine cylinders; however, it is also foreseeable that different DESTIM values can be developed for each cylinder.

To achieve ignition at the third point $T_3$, the selector means 36 calculates a control delay CNTDLY corresponding to the length of time between the reference pulse at first point $T_1$ and the desired ignition timing at the third point $T_3$. This is achieved by subtracting the desired timing value DESTIM from the reference timing value REFTIM to determine the control delay value CNTDLY. However, in prior systems a timing error $e_{TIM}$ arises due to a delay between production of the cylinder select signal at the third point $T_3$ and actual ignition at T4 (see FIG. 3C.) The timing error $e_{TIM}$ occurs as a result of the time required for the transformer to energize to a level sufficient to cause sparking. The timing error $e_{TIM}$ can degrade overall engine operation and efficiency.

The immediate invention constitutes an improvement over prior timing controls for capacitor discharge ignition systems because it actively compensates for the timing error $e_{TIM}$ by measuring the time between production of a cylinder select signal and ignition in an associated cylinder. This measured timing error $e_{TIM}$ is converted into a timing offset TIMOFFS which is used to adjust ignition timing. This is achieved by providing a combination of hardware and software for approximately sensing the timing error $e_{TIM}$. The timing offset TIMOFFS and desired timing value DESTIM are subtracted from the reference timing value REFTIM to arrive at the control delay value CNTDLY (see FIG. 2D). The selector means 36 produces the selector signal at a time $T_5$, corresponding to the control delay value CNTDLY, following the first point $T_1$, thereby causing ignition to occur at the desired time $T_3$. Preferably, individual timing errors $e_{TIM}$ are measured for each cylinder and are used to calculate individual timing offsets TIMOFFS for each cylinder. However, due to limitations on the available processing capability of the MCU, the selector means 36 currently uses the average of the individual timing errors $e_{TIM}$ to calculate a timing offset TIMOFFS which is used for all of the cylinders.

Referring now to FIG. 4, the electrical hardware required to practice the subject timing controller 8 will be discussed. The timing controller 8 measures the time between production of a cylinder select signal and ignition in a respective cylinder, as evidenced by the time at which the primary current signal reaches the first current threshold I1. The invention is based on the premise that the step-up transformers 24*a–f* have a mutual inductance between their primary and secondary coils. Our research shows that changes in transformer output loads (i.e. the characteristic spark ionization potential $V_{SP}$) can accurately be determined by sensing changes in the primary inductance. Because the voltage provided by the ignition capacitor 18 is maintained at essentially a constant magnitude by the power converter 14, an accurate indication of primary inductance and thus the timing error $e_{TIM}$ can be obtained by measuring the time required for the primary current to reach a fixed current level.

The timing controller 8 includes a first means 98 which receives the cylinder select signals, senses a time delay between reception of a cylinder select signal and sparking in an associated cylinder. It should be noted that the timing error $e_{TIM}$ is not an absolute measure because there is no absolute indication of when sparking occurs. Rather, what is measured is the time required for the primary current to reach the first current threshold I1, and this time is a function of the time required for sparking to occur. The first means 98 responsively produces a timing error signal which is indicative of the sensed delay. The first means 98 includes a timer means 100 which measures a time delay between the production of a cylinder select signal and the time at which the current in an associated cylinder reaches the first preselected current threshold I1. Preferably the timer means 100 includes a free-running clock which is internal to the MCU 38; however, it is foreseeable that the timer means 100 could be embodied in additional hardware circuitry. Production of a cylinder select signal causes a begin time (TB) to be stored in memory. The begin time (TB) corresponds to the time indicated by the free-running clock when the cylinder select signal is produced.

The first means 98 further includes a second comparator 102 having an inverting input terminal connected to the output of the first comparator 80 through a second R-C network 104. The second R-C network 104 is provided to filter high frequencies caused by ignition noise. The second comparator 102 also has a non-inverting input terminal connected to a voltage divider network 106. The voltage divider network 106 includes sixth and seventh resistors 108, 110 serially connected between a reference voltage $V_{REF}$ and system ground. The second comparator non-inverting input terminal is connected between the resistors 108, 110, thereby maintaining the non-inverting input terminal at a preselected voltage potential. Preferably the preselected voltage potential is one-half the switching voltage of the comparator 102 to ensure proper switching of the comparator 102. The output terminal of the second comparator 102 is held high by a pull-up resistor 112 as long as the inverting input terminal has a higher potential than the non-inverting input terminal. More specifically, the second comparator 102 outputs a square wave signal which tracks the output signal from the first comparator 80.

A monostable multivibrator 114 is adapted to receive the primary current signal and produce a stop time signal in response to the primary current signal reaching the first current threshold I1. The multivibrator 114 has an inverted clock pin ($\overline{CLK}$) connected to the second comparator's output terminal and being adapted to sense the comparator's output signal. An inverted reset pin ($\overline{RES}$) connected to the junction of the cylinder selector means 36 and the selector switch for receiving the selector signals. A second R-C network 116 is connected between the multivibrator 114 and the cylinder selector means 36 for filtering noise from the selector signal.

The multivibrator 114 also has an output terminal connected to an input terminal on the MCU 38. The multivibrator output terminal is adapted to produce the stop time signal when the primary current reaches the first potential. More particularly, when the current in a primary coil reaches the first current potential, the second comparator 102 output goes low. This low potential is received by the multivibrator inverted clock pin ($\overline{CLK}$), thereby turning the multivibrator 114 "on", (i.e. causing its output terminal (Q) to go high.) A timing circuit is connected to input pins on the multivibrator to lock the multivibrator 114 "on" for a predetermined period. The timing circuit 118 is connected between the multivibrator external timer pin RX/CX and a reference voltage $V_{ref}$. The timing circuit includes an eighth resistor 120 and a second capacitor which are connected between the reference potential and the external timing pin RX/CX. The components of the timing circuit are selected to keep the multivibrator 114 "on" for a preselected time, as is common in the art.

When the leading edge of the stop time signal is sensed by the MCU 38, the MCU 38 sets a stop time (TS) variable in memory in response to the time at which the stop time signal was received. This stop time corresponds to the time at which the primary current reaches the first current threshold I1. The MCU 38 calculates the timing error $e_{TIM}$ by subtracting the begin time (TB) from the stop time (TS).

Figure 5A:
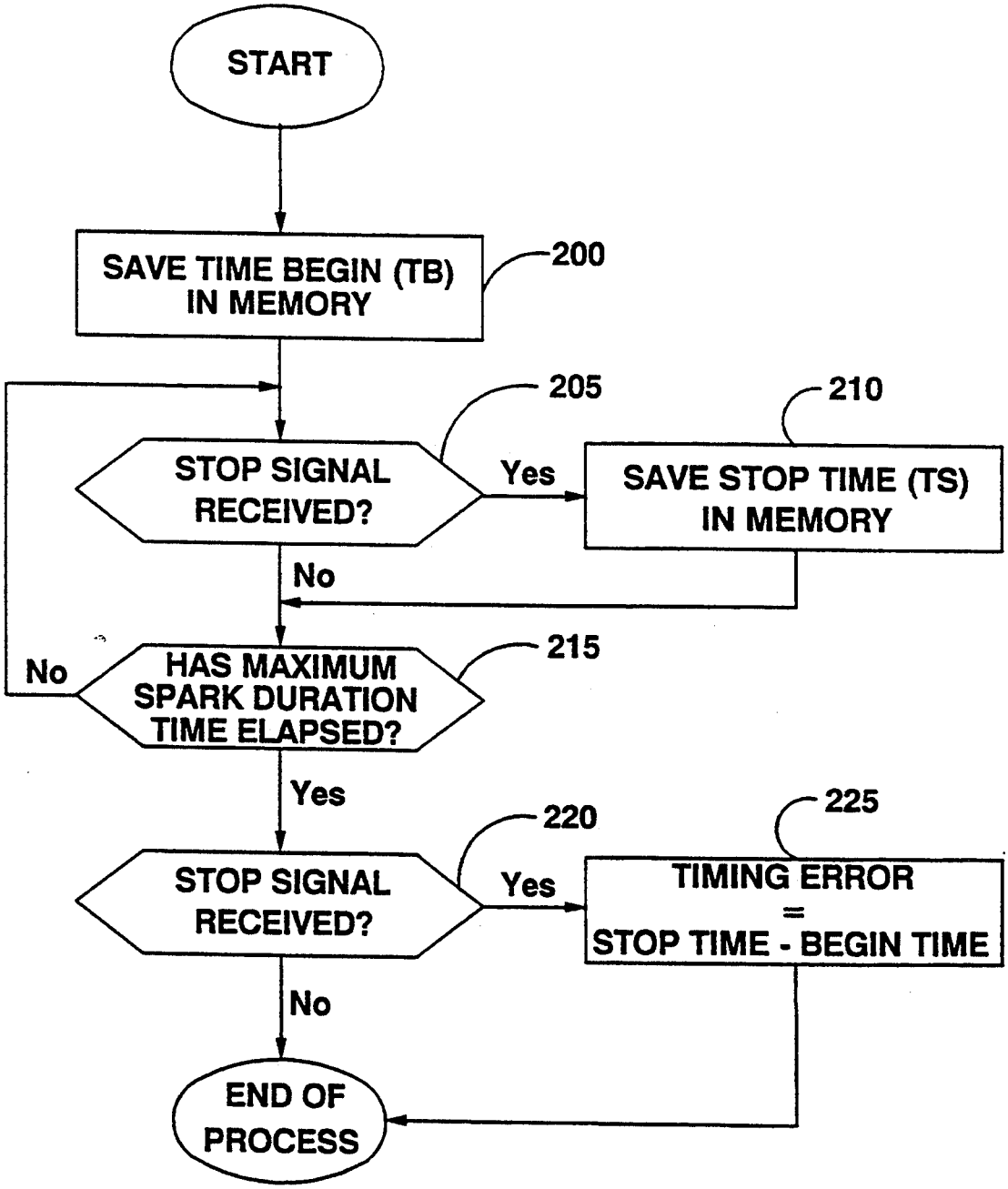
FIG. 5A is a software flowchart of a Timing Error Subroutine which can be used in programming a microprocessor to measure timing errors.
Figure 5B:
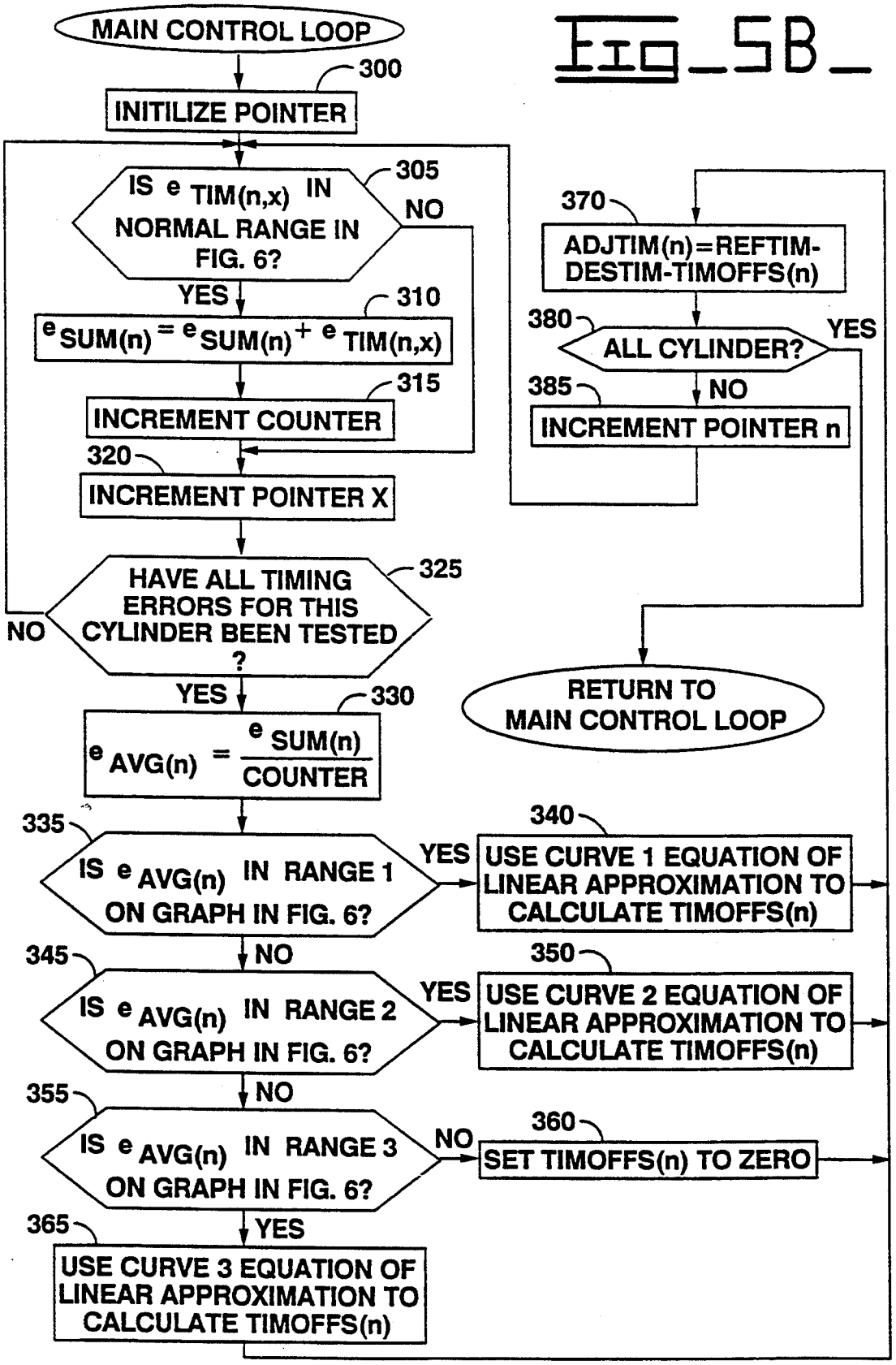

Referring now to FIGS. 5A–C, embodiments of software for controlling the MCU 38 in accordance with certain aspects of the immediate timing controller 8 is explained. FIGS. 5A–C are flowcharts illustrating computer software subroutines for implementing the preferred embodiment of the present invention. The subroutines depicted in these flowcharts are particularly well adapted for use with the MCU 38 and associated components described above, although any suitable microprocessor may be utilized in practicing an embodiment of the present invention. These flowcharts constitute a complete and workable design of the preferred software program, and have been reduced to practice on the series 6800 microprocessor system. The software subroutines may be readily coded from these detailed flowcharts using the instruction set associated with this system, or may be coded with the instructions of any other suitable conventional microprocessor. The process of writing software code from flowcharts such as these is a mere mechanical step for one skilled in the art.

FIG. 5A corresponds to a Timing Error Subroutine which is performed each time a cylinder select signal is produced to update a timing error in memory with timing errors $e_{TIM}$ for individual cylinders. FIGS. 5B and 5C represent alternate embodiments of a Timing Adjustment Subroutine which is executed each time a Main Control Routine (not shown) executes. The Timing Adjustment Subroutine retrieves timing errors $e_{TIM}$ from the timing error table and uses the timing errors $e_{TIM}$ to achieve more accurate ignition timing. FIG. 5B illustrates an embodiment wherein timing is adjusted on a individual cylinder basis. In this embodiment, the timing error table contains a plurality of timing errors $e_{TIM}$ for each cylinder. This embodiment could also be incorporated using a time averaged or filtered value of the timing errors $e_{TIM}$. Preferably, the table contains timing errors $e_{TIM}$ for the last five firings of each cylinder and the table is updated on a first-in, last-out basis. FIG. 5C illustrates an embodiment where an average of the timing errors $e_{TIM}$ for all the engine cylinders is used to adjust ignition timing for all of the cylinders. In the second embodiment, the timing error table only contains one timing error $e_{TIM}$ for each cylinder.

Referring now specifically to FIG. 5A, the Timing Error Subroutine will be discussed. The Timing Error Subroutine is triggered by an interrupt operating in real-time which causes the subroutine to be executed each time a cylinder select signal is produced. Initially, in the block 200, the begin time (TB), as indicated by the free-running clock, is stored in memory. Control is then passed to the block 205, where the routine checks to see if a stop time signal has been received from the multivibrator 114. When a stop time signal is detected in the block 205, control is passed to the block 210, thereby causing the stop time (TS) to be recorded in memory. If a stop time signal has not been received, control is passed to the block 215.

In the block 215, the time elapsed since production of the cylinder select signal, as indicated by the free-running clock, is compared to a maximum time limit. The maximum time limit is empirically determined and it corresponds to a time which is significantly longer than a timing error $e_{TIM}$ for normal ignition. In the preferred embodiment, the maximum time limit is on the order of 300 microseconds; however, this value will vary in dependance on the particular engine on which the system 8 is installed. If the elapsed time exceeds the maximum time limit, control is passed to the block 220. Otherwise control is returned to the block 205.

control continues to loop between the blocks 205 to 215 until the maximum time limit is exceeded. Thereafter, control is passed to the block 220 where memory is examined to see if a stop time (TS) was received and recorded in memory. If a stop time (TS) was recorded, control is passed to the block 225 where the timing error $e_{TIM}$ is determined by subtracting the begin time (TB) from the stop time (TS). The timing error $e_{TIM}$ is then stored in a timing error table in memory. The format of the timing error table depends on which embodiment of the Timing Adjustment Subroutine is being utilized.

Referring now to FIG. 5B a first embodiment of the Timing Adjustment Subroutine will be described. Initially in the block 300, a software pointer is set to point to the first timing error $e_{TIM}$ in the timing error table. The first embodiment calculates separate timing offsets TIMOFFS(n) for each cylinder in response to a plurality of past timing errors $e_{TIM(n,x)}$ for a respective cylinder, where n represents the cylinder and x represents the timing error. Control is then passed to the block 305 where the first timing error $e_{TIM(n,x)}$ for this cylinder is retrieved from the error table. The timing error $e_{TIM(n,x)}$ is examined to determine if it falls within an acceptable range of normal error times. As is illustrated in the FIG. 6, the timing errors $e_{TIM}$ approximately follow an exponential curve. FIG. 6 is a graph of measured actual firing delay versus the measured timing error $e_{TIM}$. Timing errors $e_{TIM}$ which fall outside the normal range are assumed to correspond to a faulty ignition condition, such as short or open circuit conditions in the secondary coil.

If the timing error $e_{TIM(n,x)}$ is not within the normal range, control is passed to the block 320 where the pointer x is incremented. Control is then passed to the block 325 where it is determined if all the timing errors $e_{TIM}$ for this cylinder have been retrieved. If they have not, control is returned to the block 305 causing the next timing error $e_{TIM(n,x)}$ to be retrieved and checked to determine if it falls within the normal range. If it does, control is passed to the block 310 where the timing error $e_{TIM(n,x)}$ is added to a timing error sum $e_{SUM(n)}$. Subsequently in the block 315 a counter is incremented to indicate the number of timing errors $e_{TIM}$ which have been added to the timing error sum $e_{SUM(n)}$.

After all of the timing errors $e_{TIM}$ for a cylinder have been checked, control is passed to the block 330 where an average timing error $e_{AVG(n)}$ is calculated by dividing the timing error sum $e_{SUM(n)}$ by the value of the counter. After the average is calculated, the counter is reset to zero and control is then passed to the block 335. In the blocks 355–360, the average timing error $e_{AVG(n)}$ is examined to determine if it falls within one of three ranges within the normal range of timing errors as shown in FIG. 6. For each of the three ranges, the actual empirically measured firing delays are linearly approximated by the lines 1,2,3 in FIG. 6. The linear approximations are then used to calculate linearly approximate a timing offset TIMOFFS(n) from the average timing error $e_{AVG(n)}$. The actual firing delay curve is empirically determined under lab conditions by sensing secondary voltage to determine when the spark plug actually fires. However, direct sensing secondary voltage on production engines is impractical because it requires an extra "tap" on the transformers and additional circuits to condition the high voltage signal from the transformer. These additional components would add unnecessary expense and complexity to the engine. Therefore, the subject invention relies on the measured timing errors $e_{TIM}$ to approximate when ignition actually occurs. It has been found that there is an approximately exponential relationship between measured timing error $e_{TIM}$ and the time at which a plug actually fires. As explained above, the exponential curve has been further subdivided into three ranges where the relationship between measured timing error $e_{TIM}$ and actual firing time can be linearized. If the delay time average does not fall within any of the three ranges, the timing offset TIMOFFS(n) is set to zero in the block 360.

Finally, in the block 370, the timing offset is used to calculate the control delay value CNTDLY(n) in accordance with the following equation:

$$CNTDLY(n)=REFTIM-DESTIM-TIMOFFS(n)$$

The control delay value CNTDLY(n) is subsequently used to control production of the cylinder select signal for a respective cylinder.

control is then passed to the block 380 where it is determined if control delay values CNTDLY have been calculated for each cylinder. If they have, control is returned to the Main Control Loop. Otherwise, control is passed to the block causing the pointer to be incremented to the next cylinder in the timing error table. The steps 305–370 are repeated until control delay values CNTDLY have been determined for each cylinder.

Referring now to FIG. 5C a second embodiment of the immediate timing control will be described. FIG. 5C generally parallels FIG. 5B with the exception that the routine is only executed once to derive a single control delay value CNTDLY which is used to adjust timing in all of the engine cylinders. The second embodiment can be used where processing time and capability are a concern. As indicated above, the timing error table for this embodiment only contains one timing error $e_{TIM(n)}$ per cylinder. Blocks 405 to 425 are repeated until all of the "normal" timing errors $e_{TIM}$ are retrieved from the timing error table and summed to arrive at a timing error sum $e_{SUM}$. An average timing error $e_{AVG}$ is subsequently calculated in the block 430 by dividing the timing error sum $e_{SUM}$ by the number of "normal" timing errors. The average timing error $e_{AVG}$ is converted into a timing offset TIMOFFS using one of three linear curves in the blocks 430 to 465. Finally, in the block 470 the control delay value CNTDLY is calculated in response to the average timing offset TIMOFFS. The control delay value CNTDLY is used to effect efficient timing in all of the cylinders.

Industrial Applicability

In operation of the engine a cylinder select means 36 produces cylinder select or ignition signals in a predetermined sequence and in response to sensed engine parameter to effect ignition in individual cylinder in accordance with a desired engine firing order. In response to production of the cylinder select signal, the Timing Error Subroutine is executed. Initially, a begin time (TB) is recorded in the block 200. The selector signal biases a respective selector switch 34 closed, thereby allowing current to flow through an associated primary coil 30. The current sensing means 62 senses the current flowing through the primary coil and responsively produces a primary current signal. The monostable multivibrator 114 responsively produces a stop time signal when the primary current reaches the first current threshold I1. The stop time signal is sensed by the MCU 38 causing a stop time (TS) to be recorded The Timing Error Subroutine continues to loop between the blocks 205 to 215 until the maximum time limit is exceeded. If a stop time was recoded, a timing error $e_{TIM}$ is calculated and stored in the timing error table.

The Timing Adjustment Subroutine executes each time the Main Control Loop is executed. The Timing Adjustment Loop retrieves the timing errors $e_{TIM}$ from the error table and calculates a timing error sum $e_{SUM}$ in response to the sum of the "normal" timing errors. Subsequently, an average timing error $e_{AVG}$ is calculated by dividing the timing error sum $e_{SUM(n)}$ by the number of "normal" timing errors. One of three linear equations it then used to convert the average timing error $e_{AVG}$ into a timing offset TIMOFFS(n). The timing offset TIMOFFS(n) is then used to calculate the control delay value CNTDLY(n) which is used to control ignition timing in the engine cylinder n. The Timing Adjustment Subroutine is repeated until control delay values values CNTDLY(n) have been calculated for each cylinder. By calculating the control delay value CNTDLY in accordance with the present invention, it is possible to actively compensate ignition timing for the delay introduced by transformer energization and more precisely effect ignition at the desired point in time.

We claim:

1. A method of controlling ignition in an engine having an ignition system, a cylinder sensor means, and a plurality of engine cylinders, each cylinder including a piston disposed therein and being movable to a top dead center (TDC) position within the cylinder, the cylinder sensor means producing a first signal representing the positions of the pistons within the respective cylinders and having a frequency responsive to engine speed, the ignition system including individual transformers for each cylinder, the transformer having respective primary coils which are energized to produce sparking across associated spark plug gaps, and wherein ignition is effected in response to a cylinder select signal, comprising the steps of:

producing a reference timing signal representing the time between a first and second reference points ($T_1$, $T_2$) of the first signal, the second reference point ($T_2$) indicating the time at which a respective piston is at the TDC position;

producing a desired timing signal representing the time between a third reference point ($T_3$) of the first signal and the second reference point ($T_2$) the third reference point ($T_3$) occurring prior to the second reference point ($T_2$) and indicating the time at which ignition desirably occurs;

sensing a delay between production of the cylinder select signal and the time required for the current flowing through a respective primary coil to reach a preselected current threshold which is normally sufficient to cause a spark to arc an associated spark gap and responsively producing a timing error signal;

processing the timing error signal to produce a timing offset signal;

producing a control delay signal responsive to the reference timing signal less the timing offset signal and a desired timing signal;

delivering the cylinder select at a time, as represented by the control delay signal, subsequent to the first reference point ($T_1$) on the first signal, thereby compensating for the timing error introduced by the time required for transformer energization; and repeating the foregoing steps for each engine cylinder.

2. An apparatus as set forth in claim 1 wherein the timing offset signal is produced in response to an average of the timing error signals for a respective cylinder during a predetermined number of engine cycles.

3. An apparatus as set forth in claim 1 wherein a single timing offset signal is produced in response to an average of the timing error signals for all the engine cylinders during t least one engine cycle.

4. A method as set forth in claim 1, wherein said step of processing the timing error signal to produce a timing offset delay includes the steps of:

comparing said timing error signal to an empirically determined graph that correlates timing error signals to timing offset signals; and reading a timing offset delay signal from said graph.

5. A method as set forth in claim 4, wherein said step of comparing said timing error signal includes the steps of:

classifying said timing error signal within one of three predetermined ranges of timing error signals;

reading an offset delay from said graph; and wherein said graph is linearly approximated in each of the three predetermined ranges.

6. A method as set forth in claim 5, including the steps of;

sensing a delay between production of the cylinder select signal and the time required for the current flowing through a respective primary coil to reach a preselected current threshold which is normally sufficient to cause a spark to arc an associated spark gap for each of the plurality of engine cylinders and responsively producing individual timing error signals;

producing an average timing error signal; and processing the average timing error signal to produce a timing offset signal responsively producing an timing error signal.

7. A method as set forth in claim 6, wherein said step of processing the timing error signal to produce a timing offset signal includes the steps of:

comparing the individual timing error signals to a maximum time limit value, wherein said maximum time limit value is an empirically determined value corresponding to time that is longer than required for ignition; and producing said average timing error signal from said plurality of individual timing error signals that are less than said maximum time limit value.

8. A method of controlling ignition in an engine having an ignition system, a cylinder sensor means, and a piston disposed in a cylinder and being movable to a top dead center (TDC) position, the cylinder, sensor means producing a first signal representing the position of the piston within the cylinder and having a frequency responsive to engine speed, the ignition system including a transformer having respective primary coils which is energized to produce sparking across an associated spark plug gap and wherein ignition is effected in response to a cylinder select signal, comprising the steps of:

producing a reference timing signal representing the time between a first and second reference points ($T_1$, $T_2$) of the first signal, the second reference point ($T_2$) indicating the time at which a respective piston is at the TDC position;

producing a desired timing signal representing the time between a third reference point ($T_3$) of the first signal and the second reference point ($T_2$), the third reference point ($T_3$) occurring prior to the second reference point ($T_2$) and indicating the time at which ignition desirably occurs;

sensing a delay between production of the cylinder select signal and the time required for the current flowing through a respective primary coil to reach a preselected current threshold which is normally sufficient to cause a spark to arc an associated spark gap and responsively producing a timing error signal;

producing a timing offset signal in response to an average of the timing error signals for a respective cylinder during a predetermined number of engine cycles;

producing a control delay signal responsive to the reference timing signal less the timing offset signal and a desired timing signal; and delivering the cylinder select at a time, as represented by the control delay signal, subsequent to the first reference point ($T_1$) on the first signal, thereby compensating for the timing error introduced by the time required for transformer energization.

9. An apparatus as set forth in claim 8 wherein the timing offset signal is produced in response to an average of the timing error signals for a respective cylinder during a predetermined number of engine cycles.

10. An apparatus for controlling ignition in an engine having an ignition system, an engine cylinder sensor means, and a piston disposed in the cylinder and being movable to a top dead center (TDC) position, the cylinder sensor means producing a first signal representing the position of the piston within the cylinder and having a frequency responsive to engine speed, the ignition system including a transformer having a primary coil which is energized to produce sparking across an associated spark plug gap, and wherein ignition is effected in response to a cylinder select signal, comprising:

first means for sensing a delay between production of the cylinder select signal and the time required for the current flowing through the primary coil to reach a preselected current threshold which is normally sufficient to cause a spark to arc the spark gap and responsively producing a timing error signal;

cylinder select means for receiving the first signal and the timing error signal, processing the first signal to produce a reference timing signal representing the time between first and second reference points ($T_1$, $T_2$) of the first signal, the second reference point ($T_2$) indicating the time at which the piston is at the TDC position, producing a desired timing signal representing the time between a third reference point ($T_3$) of the first signal and the second reference point ($T_2$), the third reference point ($T_3$) occurring prior to the second reference point ($T_2$) and indicating the time at which ignition desirably occurs, processing the timing error signal to produce a timing offset signal, producing a control delay signal responsive to the reference timing signal less the timing offset signal and a desired timing signal, and delivering the cylinder select signal at a time, as represented by the control delay signal, subsequent to the first point ($T_2$) on the first signal, thereby compensating for the timing error introduced by the time required for transformer energization.

11. An apparatus (8) as set for in claim 10 wherein the timing offset signal is produced in response to an average of the timing error signals for a respective cylinder during a predetermined number of engine cycles.

12. An apparatus according to claim 10, wherein said cylinder select means includes:

comparing means for comparing said timing error signal to an empirically determined graph that correlates timing error signals to timing offset signals and reading a timing offset delay signal from said graph.

13. An apparatus as set forth in claim 12, wherein said cylinder select means includes means for comparing said timing error signal to an empirically determined graph that correlates timing error signals to timing offset signals and reading a timing offset delay signal from said graph.

14. An apparatus as set forth in claim 13, wherein said cylinder select means includes means for classifying said timing error signal within one of three predetermined ranges of timing error signals, and reading an offset delay from said graph, wherein said graph is linearly approximated in each of the three predetermined ranges.

15. An apparatus as set forth in claim 14, wherein said cylinder select means includes means for sensing a delay between production of the cylinder select signal and the time required for the current flowing through a respective primary coil to reach a preselected current threshold which is normally sufficient to cause a spark to arc an associated spark gap for each of the plurality of engine cylinders and responsively producing individual timing error signals, producing an average timing error signal, and processing the average timing error signal to produce a timing offset signal responsively producing an timing error signal.

16. An apparatus as set forth in claim 15, wherein said cylinder select means includes means for comparing the individual timing error signals to a maximum time limit value, wherein said maximum time limit value is an empirically determined value corresponding to time that is longer than required for ignition, and producing said average timing error signal from said plurality of individual timing error signals that are less than said maximum time limit value.

17. An apparatus for controlling ignition in an engine having an ignition system, an engine cylinder sensor means, and a piston disposed in the cylinder and being movable to a top dead center (TDC) position, the cylinder sensor means producing a first signal representing the position of the piston within the cylinder and having a frequency responsive to engine speed, the ignition system including a transformer having a primary coil which is energized to produce sparking across an associated spark plug gap, and wherein ignition is effected in response to a cylinder select signal, comprising:

first means for sensing a delay between production of the cylinder select signal and ignition in the cylinder and responsively producing a timing error signal;

cylinder select means for receiving the first signal and the timing error signal, processing the first signal to producing a reference timing signal representing the time between first and second reference points ($T_1$, $T_2$) of the first signal, the second reference point ($T_2$) indicating the time at which the piston is at the TDC position, producing a desired timing signal representing the time between a third reference point ($T_3$) of the first signal and the second reference point ($T_2$), the third reference point ($T_3$) occurring prior to the second reference point ($T_2$) and indicating the time at which ignition desirably occurs, processing the timing error signal to produce a timing offset signal, producing a control delay signal responsive to the reference timing signal less the timing offset signal and a desired timing signal, and delivering the cylinder select signal at a time, as represented by the control delay signal, subsequent to the first point ($T_2$) on the first signal, thereby compensating for the timing error introduced by the time required for transformer energization; and wherein said first means includes a current sensing means for sensing the current flowing through the primary coil and responsively producing a primary current signal, a monostable multivibrator adapted to receive the primary current signal and produce a stop time signal in response to the primary current signal reaching a preselected current threshold, and timer means for receiving the cylinder select and stop time signals and producing the delay signal in response to a time delay between the reception of the cylinder select and stop time signals.

18. An apparatus as set forth in claim 17 wherein the engine includes a plurality of cylinders and a single timing offset signal is produced in response to an average of the timing error signals for all the engine cylinders during at least one engine cycle.

19. An apparatus as set forth in claim 17 wherein the engine includes a plurality of cylinders and a single timing offset signal is produced in response to an average of the timing error signals for all the engine cylinders during at least one engine cycle.

* * * * *

UNITED STATES PATENT AND TRADEMARK OFFICE

CERTIFICATE OF CORRECTION

PATENT NO. : 5,337,717

DATED : August 16, 1994

INVENTOR(S) : Horst Scheel et al.

It is certified that error appears in the above-identified patent and that said Letters Patent is hereby corrected as shown below:

Column 13, claim 2, line 26, "An apparatus" should be --A method--.

Column 13, claim 3, line 30, "An apparatus" should be --A method--.

Column 14, claim 8, line 13, "respective" should be --a--;
"coils" should --coil--.

Column 14, claim 8, line 22, "a respective" should be --the--.

Column 14, claim 9, line 49, "An apparatus" should be --A method--.

Signed and Sealed this

Twenty-first Day of February, 1995

*Attest:*

Bruce Lehman

BRUCE LEHMAN

*Attesting Officer*

*Commissioner of Patents and Trademarks*